United States Patent [19]

Boucraut

[11] 4,334,365

[45] Jun. 15, 1982

[54] METHODS OF DRYING WET ITEMS OF TEXTILE MATERIALS

[75] Inventor: Frantz M. J. Boucraut, Troyes, France

[73] Assignee: Valton S.A., Troyes, France

[21] Appl. No.: 197,122

[22] Filed: Oct. 15, 1980

[30] Foreign Application Priority Data

Oct. 18, 1979 [FR] France ..... 79 25912

[51] Int. Cl.[3] ..... F26B 5/08

[52] U.S. Cl. ..... 34/8; 34/58; 26/84

[58] Field of Search ..... 34/8, 58, 104, 105, 34/110, 112; 26/84, 86; 68/23 R, 150

[56] References Cited

U.S. PATENT DOCUMENTS

| | | | |
|---|---|---|---|
| 2,099,081 | 11/1937 | Russ, Jr. | 34/58 |
| 2,657,472 | 11/1953 | Fry, Jr. | 34/8 |
| 3,811,159 | 5/1974 | Cecere | 26/84 |

*Primary Examiner*—Larry I. Schwartz

*Attorney, Agent, or Firm*—Murry and Whisenhunt

[57] ABSTRACT

There is described a method of drying wet items of textile material, in which the wet item is rolled onto a roller and in the process subjected to a width-increase of at least 15% in the transverse direction while being fed without tension in the longitudinal direction, until the outer diameter obtained is substantially equal to the internal diameter of a perforated retaining sleeve into which the rolled item is introduced for subjection to a spin-drying operation.

8 Claims, No Drawings

METHODS OF DRYING WET ITEMS OF TEXTILE MATERIALS

The invention concerns methods of drying wet items of textile material.

Objects of the invention include the provision of a method of drying wet items of textile material which are of a woven, non-woven, knitted or other form and are laden with moisture to the point of saturation. The items to be dried may be of various widths and of considerable lengths and be of single or double thickness, (double thickness denoting the state of tubular items produced by circular looms or knitting machines and laid flat by folding along two opposing generating lines).

At present four main mechanical systems are used to remove the maximum possible amount of water from wet items; the items may be squeezed by being passed between two squeezing rollers, the items may be placed in a crudely annular fashion inside a spin dryer, water may be continuously driven out of the items with the aid of an air knife, or the water may be expelled from the items by rolling and suction.

The invention concerns specifically a drying method utilizing a spin-drying drum; and has as its main objective the achievement of a significant improvement in the efficiency of the spin-drying operation.

One of the disadvantages of spin-drying wet items is that the items are distorted under the influence of the centrifugal force as they spin, which is particularly inconvenient if the fabric is knitted. In fact, there is a danger that the distortions will remain permanently in the fabric or that the fabric will be torn or otherwise flawed.

In accordance with the invention, there is provided a method of drying a wet item of textile material in which said item is rolled up onto a roller and subjected to a width-increase of at least 15% in the transverse direction before being introduced into a perforated, annular retaining sleeve drivable to rotate within a protective casing, in which the rate at which rolling takes place is monitored such that the item is not subjected to tension longitudinally thereof and in which the rolling is continued until the external diameter of the item and roller is substantially equal to the internal diameter of said retaining sleeve.

The external gross diameter of the textile item and roller needs to be less than but substantially equal to the internal diameter of the sleeve, the difference between the two diameters being just enough to allow the roller, with the textile item rolled onto it, to be introduced without difficulty into the retaining sleeve by aligning the axes of the roller and the sleeve and moving the roller, axially, into the sleeve.

By way of example a knitted item soaked to saturation point (200% laden with liquid on leaving a dyeing vat) was dried satisfactorily using a roller having a diameter of 1.30 m. After rolling the knitted item onto the roller, with a transverse width increase of 20% but without applying tension longitudinally of the item, the external diameter of the rolled knitted item was 1.50 m. The radial thickness of the item was therefore 10 cm. Spin-drying was effected at a speed of 750 r.p.m.

The thickness of the rolled textile item depends upon the diameter of the roller, the nature of the item and its fabric, and the spin-drying speed. During the spinning operation, the outermost layers of the item are urged against the perforated sleeve and the inner layers are pressed against the outermost layers. During this squeezing the layers of the item increase in diameter and undergo circumferential elongation. In general, during the spin-drying process, elongation greater than a value in the range of 5 to 10% of the length prior to drying must be avoided.

The method of the invention may be implemented using known means. The increase in width of the item may be effected using a machine designed for that purpose, for example a machine such as that described in U.S. Pat. No. 3,811,159 in which the roller is fed, with widened textile material, by advancing the item at a speed, in the rectilinear direction, equal to or slightly greater than the circumferential speed of the outermost layer during rolling onto the roller. In this way the textile item is rolled onto the roller free of tension to an extent determined by the choice of value for the width increase and the feed rate.

Operating in this fashion, it has been found that an item rolled onto a roller in this way can withstand a higher centrifugal force than is the case with known methods; before the inner layers of material become unacceptably stretched. The result of this spin-drying method is more even drying and a treated item of better quality.

As stated above, the method of the invention has the advantage that it makes it possible to spin-dry very wide textile items, or tubular items, whether or not they can stretch. It is enough to be able to roll them up onto a roller and then introduce into an annular perforated sleeve. It has been shown to be preferable to use a roller of substantial diameter and to roll the item thereon to a reduced thickness (generally between 10 and 20 cm) although the upper noted figure may be exceeded.

Such a thickness is favourable for even drying throughout and, when allied to tension free rolling limits the effects of elongation of the textile item whilst it is inside the annular sleeve and is being spun.

Thus, it has been found that the drying time required with the method of the invention is less than that required with conventional spin-drying to attain comparable residual moisture levels.

I claim:

1. A method of drying a wet item of textile material, said method comprising rolling said item up onto a roller and subjecting said item to a width-increase transversely thereof of at least 15% before introducing said item rolled up on said roller into a perforated, annular retaining sleeve drivable to rotate within a protective casing, said rolling taking place at a rate such that the item is not subjected to tension longitudinally thereof, said rolling being continued until a series of layers of said item are on said roller, and said item and roller has an external diameter substantially equal to the internal diameter of said retaining sleeve, whereby upon subjecting said item on said roller to a centrifugal force, outermost layers of said item are urged against said retaining sleeve and inner layers are pressed against said outermost layers to dry said item.

2. The method of claim 1, in which said item of textile material is rolled onto said roller until said item has a radial thickness in the range of between 10 and 20 centimeters.

3. The method claim 1, in which said roller has a diameter of at least 1.30 meters.

4. The method of claim 1, wherein said item of textile material is an item of knitted material saturated with liquid, said item of knitted material being subjected to a width-increase of about 30% whilst being fed without tension onto said roller.

5. A method of drying a wet item of textile material, said method comprising:

providing a roller and a perforated annular retaining sleeve, said roller being axially receivable within said sleeve;

rolling said wet item of textile material onto said roller prior to axially introducing said roller into said retaining sleeve, and subjecting said textile material to a width-increase transversely thereof of at least 15%, said rolling being conducted at a rate such that said item is not subjected to tension longitudinally thereof as said item is rolled onto said roller, said rolling being continued until a series of layers of said item are on said roller, and said item has a external diameter on said roller substantially equal to the internal diameter of said retaining sleeve;

introducing said roller having thereon layers of said wet item of width-increased textile material into said retaining sleeve; and subjecting said wet item of width-increased textile material on said roller to a centrifugal force to urge outermost layers of said item against said retaining sleeve and press inner layers against said outermost layers to dry said item.

6. The method of claim 5, wherein said item of textile material is an item of knitted material.

7. The method of claim 5, wherein said item of textile material is an item of woven material.

8. The method of claim 5, wherein said item of textile material is an item of non-woven material.

* * * * *